United States Patent [19]

Isozumi

[11] Patent Number: 4,962,340

[45] Date of Patent: Oct. 9, 1990

[54] ENGINE STARTER WITH VARIABLE LENGTH FRONT BRACKET

[75] Inventor: Shuzoo Isozumi, Himeji, Japan

[73] Assignee: Mitsubishi Denki Kabushiki Kaisha, Tokyo, Japan

[21] Appl. No.: 298,435

[22] Filed: Jan. 18, 1989

[30] Foreign Application Priority Data

Jan. 18, 1988 [JP] Japan ..... 63-9040

[51] Int. Cl.[5] ..... F02N 11/00

[52] U.S. Cl. ..... 290/48; 74/7 R

[58] Field of Search ..... 290/38 R, 48; 74/6, 74/7 R, 7 B; 310/91

[56] References Cited

U.S. PATENT DOCUMENTS

| | | | |
|---|---|---|---|
| 4,347,442 | 8/1982 | White et al. | 290/48 |
| 4,661,715 | 4/1987 | Volino | 290/48 |
| 4,695,735 | 9/1987 | Tallis, Jr. et al. | 290/48 X |
| 4,760,274 | 7/1988 | Isozumi | 290/48 |
| 4,862,027 | 8/1989 | Isozumi et al. | 74/7 R X |

FOREIGN PATENT DOCUMENTS 1311876 11/1962 France .

*Primary Examiner*—A. D. Pellinen
*Assistant Examiner*—W. E. Duncanson, Jr.
*Attorney, Agent, or Firm*—Sughrue, Mion, Zinn, Macpeak & Seas

[57] ABSTRACT

An engine starter has a cup-shaped front bracket 24 for containing an output rotary shaft 23 having a pinion 28 on its front end and axially slidable, a driving force transmitting unit 22, an electric motor 21 having a hollow cylindrical yoke fitted in rear a opening of the front bracket, and a solenoid switch 30 mounted to the rear portion of the electric motor and having an operating rod 35, 38 which extends through the interior of the electric motor to abut against the output rotary shaft for pushing out the output rotary shaft. The front bracket has on its outer periphery a mounting flange 42 of a mounting spigot joint diameter larger than the outer diameter of an inner gear **25*b*** of a planetary speed reduction gear of the driving force transmitting unit or the outer diameter of the yoke of the electric motor.

3 Claims, 4 Drawing Sheets

ENGINE STARTER WITH VARIABLE LENGTH FRONT BRACKET

BACKGROUND OF THE INVENTION

This invention relates to an engine starter and, more particularly, to an engine starter for a vehicular engine.

A conventional vehicular engine starter is constructed as illustrated in FIG. 1. The conventional engine starter 1 shown in FIG. 1 comprises a d.c. motor 2, an over-running clutch 4 slidably fitted over an output rotary shaft 3, a planetary speed reduction gear 5 for reducing the rotational force of the armature rotary shaft 2*a* of the d.c. motor 2 to transmit it to the clutch outer member 4*a* of the over-running clutch 4 through the output rotary shaft 3, and a shift lever 8 for sliding the over-running clutch 4 along the output rotary shaft 3, the shift lever 8 engaging at its one end with the plunger rod of a solenoid switch 6 mounted on a side of the d.c. motor 2 and being connected at its the other end to an annular member 7 mounted to the over-running clutch 4.

However, in the conventional engine starter as shown in FIG. 1, the solenoid switch 6 for moving the shift lever 8 and for closing electrical contacts connecting an electrical source to the d.c. motor 2 is positioned on one side of the d.c. motor 2 in a parallel, side-by-side relationship and the shift lever 8 must be provided for slidably moving the over-running clutch 4 along the output rotary shaft 3 into engagement with the engine ring gear. Therefore, with the conventional starter, a mounting flange for mounting the starter to an engine must be attached to the front bracket 10 at a position in front of the solenoid switch 6. Therefore, a problem is posed that the distance between the pinion 11 and a mounting surface 9*a* of the mounting flange 9 cannot be increased as desired, often making it impossible to mount the engine starter to an engine in which the distance between the engine ring gear and the mounting surface of the engine to which the starter is mounted is relatively large.

SUMMARY OF THE INVENTION

Accordingly, one object of the present invention is to provide an engine starter free from the above-discussed problem of the conventional design.

Another object of the present invention is to provide an engine starter which has a sufficient distance between the pinion and the mounting flange.

With the above objects in view, the engine starter of the present invention comprises a cup-shaped front bracket for containing therein an output rotary shaft having a pinion on its front end and axially slidable and a driving force transmitting unit, an electric motor having a hollow cylindrical yoke fitted in rear opening of the front bracket, and a solenoid switch mounted to the rear portion of the electric motor and having an operating rod which extends through the interior of the electric motor to abut against the output rotary shaft for pushing out the output rotary shaft. The front bracket has on its outer periphery a mounting flange of a mounting spigot joint diameter larger than the outer diameter of an inner gear of a planetary speed reduction gear of the driving force transmitting unit or the outer diameter of the yoke of the electric motor.

In the engine starter of the present invention, the solenoid switch is disposed behind the electric motor which drives the output rotary shaft, the operational rod of the solenoid switch extends through the electric motor shaft to abut against the rear end of the output rotary shaft so that the output rotary shaft may be pushed forward, and the tubular motor yoke is inserted and fitted into the rear opening of the cup-shaped front bracket. Therefore, the length of insertion of the motor yoke into the front bracket can be substantially freely selected, so that the mounting flange on the outer circumference of the front bracket can be located at any desired axial position on the front bracket.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
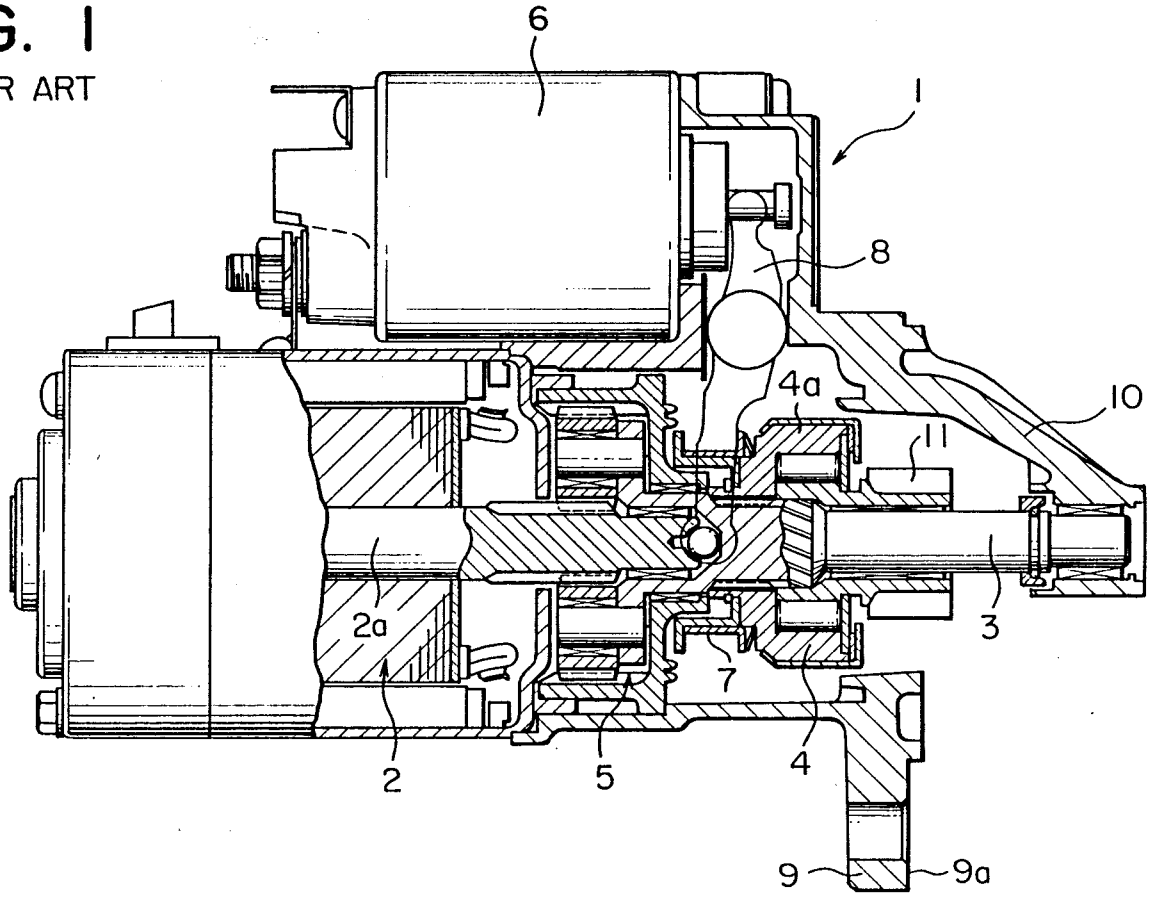
FIG. 1 PRIOR ART
FIG. 1 is a sectional view of the conventional engine starter in which the starter motor and the solenoid switch are arranged side-by-side.
Figure 2:
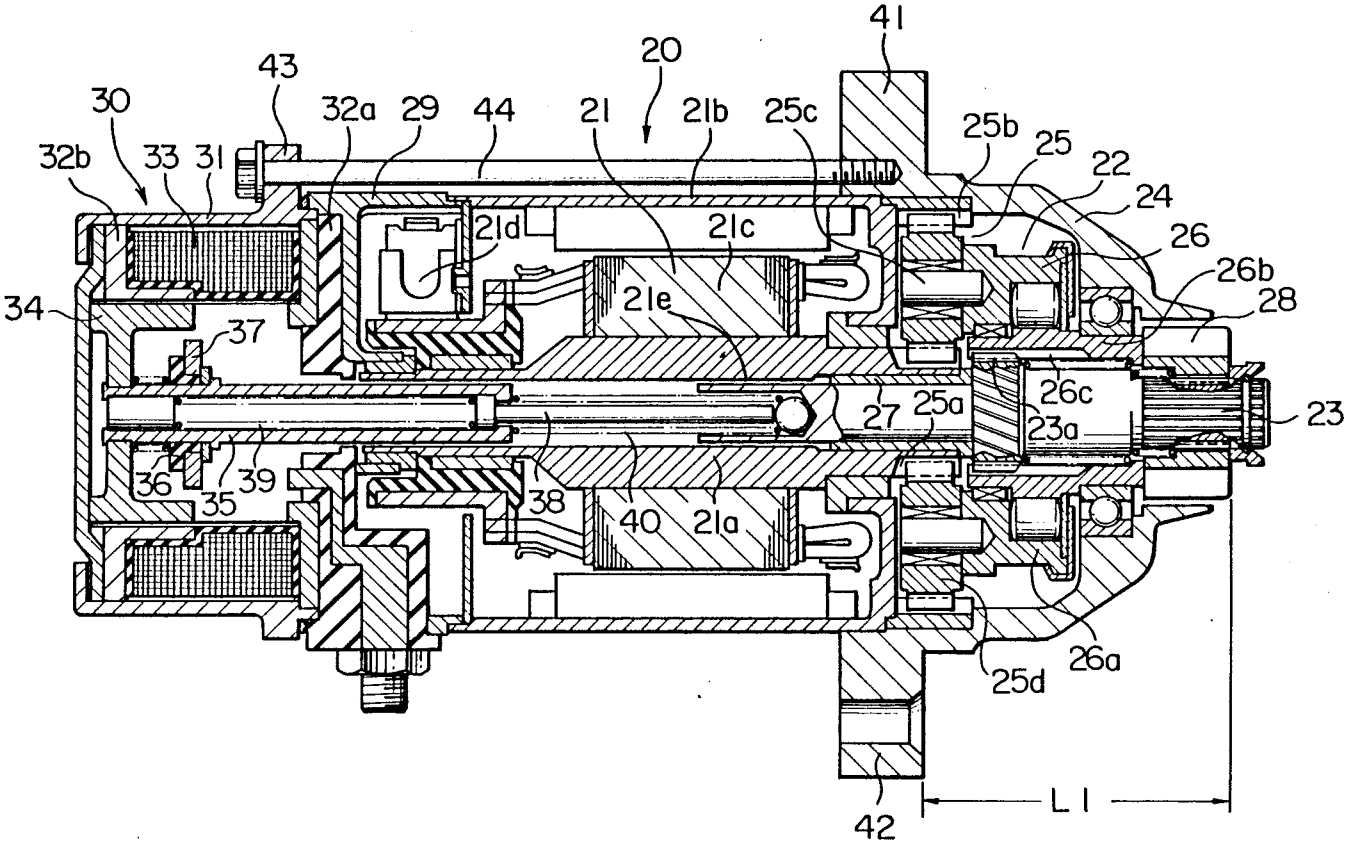
FIG. 2 is a sectional view of a coaxial engine starter of one embodiment of the present invention.

FIG. 2 illustrates a coaxial engine starter 20 of one embodiment of the present invention which comprises a d.c. motor 21 having a hollow cylindrical yoke 21*b* serving as a frame of the starter and a tubular armature rotary shaft 21*a* coaxially disposed within the yoke 21*b*. An armature core 21*c* is press-fitted over the outer circumference of the tubular armature rotary shaft 21*a*, and a commutator 21*d* is mounted on the rearward side (on the left as viewed in FIG. 2) of the armature core 21*c* by press-fit for example.

The axial front end of the yoke 21*b* of the d.c. electric motor 21 is fitted by the rear opening of a cup-shaped front bracket 24 within which a driving force transmitting mechanism 22 and an output rotary shaft 23 are housed. The driving force transmitting mechanism 22 comprises a planetary speed reduction gear 25, a one-way clutch 26, helical splines 26*c* formed in the inner circumferential surface of a clutch inner member 26*b* of the one-way clutch mechanism 26, and helical splines 23*a* formed in the output rotary shaft 23 in mesh with the helical splines 26*c* of the clutch inner member 26*b*. The output rotary shaft 23 is disposed in an axially aligned relationship with the armature rotary shaft 21*a* with its one end inserted into an inner passage 21*e* of the armature rotary shaft 21*a* to be axially slidably supported by a sleeve bearing 27 disposed between the output rotary shaft 23 and the inner surface of the hollow armature rotary shaft 21*a*.

The rotation of the armature rotary shaft 21*a* is transmitted to the output rotary shaft 23 through a planetary speed reduction gear 25 and the one-way clutch which is an over-running clutch 26. That is, the planetary speed reduction gear 25 comprises a sun gear 25*a* integrally formed on the outer circumference of one end of the armature rotary shaft 21*a*, an inner gear 25*b* formed in the front bracket 24 which is a frame member of the starter motor 21, and a plurality of planetary gears 25*d* supported by shafts 25*c* on a clutch outer member 26*a* of the over-running clutch 26 and in mesh with the sun gear 25*a* and the inner gear 25*b*. Also, helical splines 26*c* formed in the inner circumferential surface of the clutch inner member 26*b* of the over-running clutch 26 are engaged with helical splines 23*a* formed on the outer circumferential surface of the output rotary shaft 23, so that the output rotary shaft 23 is permitted to slide in the axial direction while it can rotate by the rotational force transmitted from the clutch inner member 26*b*. On the front end of the output rotary shaft 23 projecting from the front bracket 24, a pinion 28 is disposed for engagement with the ring gear of the engine (not shown).

On the rear end (on the left as viewed in FIG. 2) of the d.c. motor 21, a rear bracket 29 is mounted, and a solenoid switch 30 is mounted on the rear side of the rear bracket 29. When an unillustrated ignition switch of the vehicle is closed, the solenoid switch 30 causes a sliding movement of the output rotary shaft 23 and closes the contacts for energizing the d.c. motor 21 by a battery. The solenoid switch 30 comprises an excitation coil 33 wound on a plastic bobbin supported by front and rear cores 32*a* and 32*b* defining, together with a case 31, a magnetic circuit, a plunger 34 slidably disposed within a central bore of the bobbin, a tubular rod 35 secured at one end to the plunger 34 and inserted at the other end into the inner passage 21*e* of the armature rotary shaft 21*a*, and a movable contact 37 supported on the rod 35 by an electrically insulating member 36. Within the tubular rod 35, a push rod 38 is slidably inserted. The push rod 38 extends forward from the front end opening of the tubular rod 35 and its front end abuts against the bottom of the recess formed in the end surface of the output rotary shaft 23 through a steel ball. The tubular rod 35 and the push rod 38 are biased in their respective directions by springs 39 and 40.

It is seen that the cup-shaped front bracket 24 is provided at its outer periphery of the rear open end with an assembly flange 41 and a mounting flange 42. The assembly flange 41 has formed in the rear surface thereof threaded holes into which bolts 44 extend through a flange 43 on the case 31 of the solenoid switch 30. When the bolts 44 are tightened, the yoke 21*b* of the d.c. motor 21 and the rear bracket 29 are securely held between the front bracket 24 and the case 31.

Figure 3:
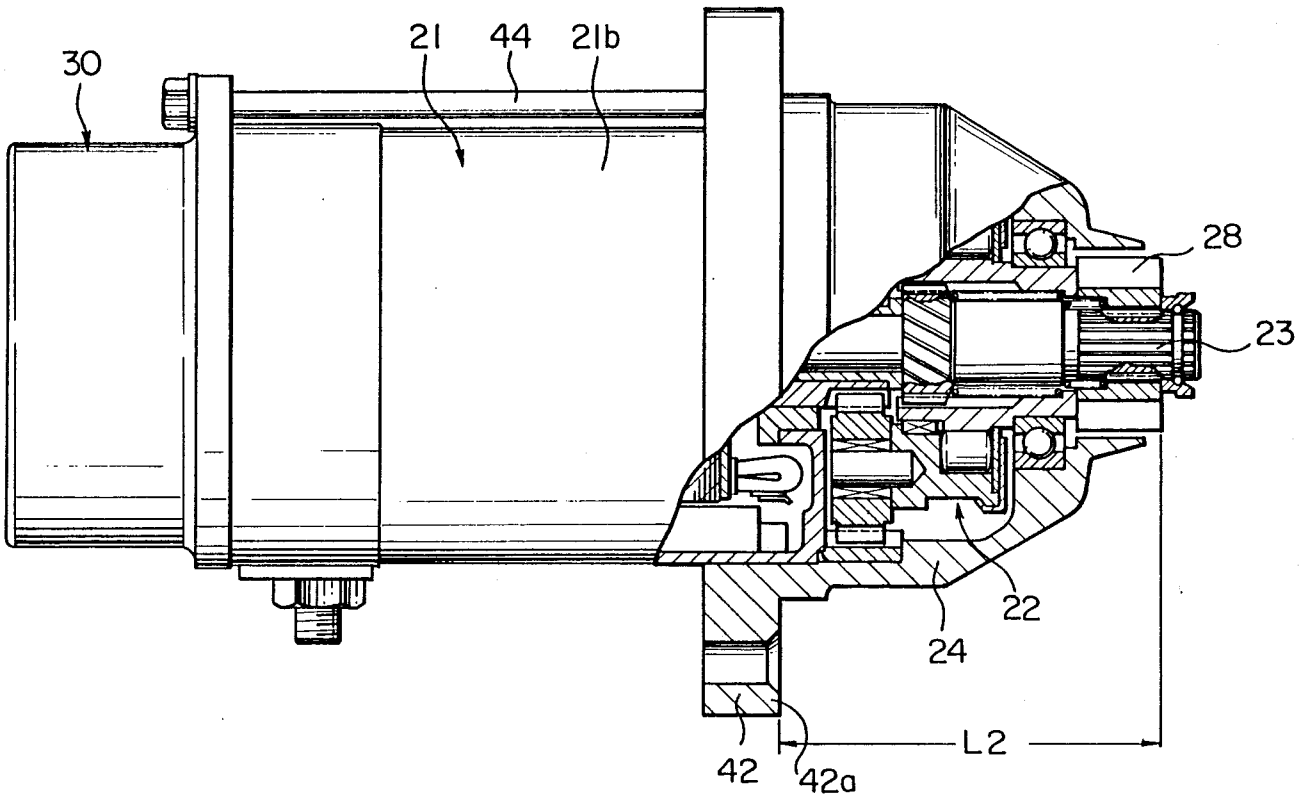
FIG. 3 is a partial sectional view of a coaxial engine starter of another embodiment of the present invention.
Figure 4:
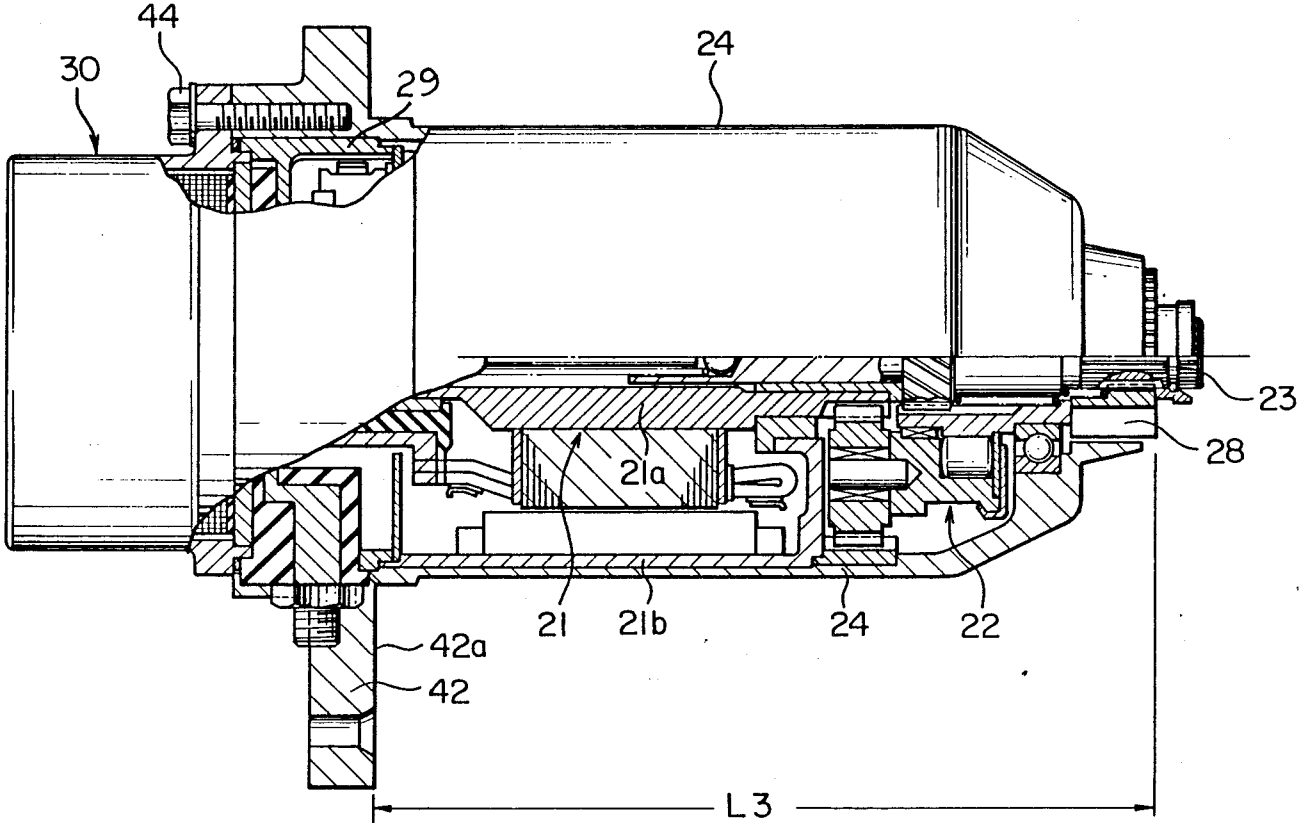
FIG. 4 is a partial sectional view of a coaxial engine starter of still another embodiment of the present invention.

The engine starter 20 thus assembled can be securely mounted to the engine by bolts with the front end of the mounting flange 42 brought into an intimate contact with the mounting surface of the engine. With the construction as above described, the distance L1 between the mounting surface 42*a* of the mounting flange 42 and the front end of the pinion 28 when it is in the rearward position can be freely selected according to the corresponding dimension of the engine. For example, when the distance between the ring gear of an engine and a mounting surface to which the engine starter is mounted is larger than the distance L1 shown in FIG. 2, the length along which the front bracket 24 fits over the yoke 21*b* of the motor 21 can be increased until the length L1 between the front end of the pinion 28 and the front end 42*a* of the mounting flange 42 reaches a desired length L2, as shown in FIG. 3;

FIG. 4 illustrates another modification of the engine starter motor of the present invention, in which the front bracket 24 is sufficiently long to cover substantially all of the yoke 21*b* of the d.c. motor 21. This arrangement allows the mounting flange 42 to be rearwardly positioned at about the position of the rear bracket 29, establishing a desired length L3 As to the total thickness of the front bracket 24 and the yoke 21*b* where they are overlapped, since the yoke 21*b* of a d.c. motor can be made thin when the motor has six magnetic poles or more, the cylindrical portion of the engine starter does not become unnecessarily large, and the mounting of the starter to an engine can be made easily in a wider space.

As has been described, according to the engine starter of the present invention, the output rotary shaft and the armature rotary shaft are coaxially disposed and the solenoid switch is disposed behind the electric motor which drives the output rotary shaft, and the operational rod of the solenoid switch extends through the electric motor shaft to abut against the rear end of the output rotary shaft so as to push the output rotary shaft forward, so that the tubular motor yoke is inserted and fitted into the rear opening of the cup-shaped front bracket. Therefore, the length of insertion of the motor yoke into the front bracket can be substantially freely selected, so that the mounting flange on the outer circumference of the front bracket can be located at a desired position sufficiently rearward from the pinion gear to provide the necessary distance between the pinion and the mounting flange corresponding to the ring gear and the mounting surface on the engine. Thus, the engine starter of the present invention can be easily adapted to an engine having a long distance between the ring gear and the mounting surface on the engine.

What is claimed is:

1. An engine starter, comprising:

a cup-shaped front bracket (24) housing an axially slidable output rotary shaft (23) having a pinion (28) on a front end thereof, and a driving force transmitting unit (22);

an electric motor (21) having a hollow cylindrical yoke (21b) fitted in a rear opening of said front bracket; and a solenoid switch (30) mounted to a rear portion of said electric motor and having an operating rod means (35, 38) which extends through an interior of said electric motor to abut against said output rotary shaft for pushing out said output rotary shaft;

said front bracket having on an outer rear periphery thereof a mounting flange (42) having an inner diameter larger than an outer diameter of an inner gear (25*b*) of a planetary speed reduction gear of said driving force transmitting unit and larger than an outer diameter of the yoke of said electric motor.

2. An engine starter according to claim 1, wherein an axial length between a front edge of the pinion in a retracted position and a front face of the mounting flange is selected to accommodate a corresponding dimension of an engine to which the starter is mounted.

3. An engine starter according to claim 1, wherein the solenoid switch is assembled to the front bracket by axially parallel bolts (44) engaged in the mounting flange, with the motor yoke and inner gear being clamped between said switch and said bracket.

* * * * *